US007698849B2

(12) United States Patent
O'Dwyer et al.

(10) Patent No.: US 7,698,849 B2
(45) Date of Patent: Apr. 20, 2010

(54) COMBINED ELECTRICAL MECHANICAL FIRING SYSTEMS

(75) Inventors: James Michael O'Dwyer, Brisbane (AU); Sean Patrick O'Dwyer, Norman Park (AU)

(73) Assignee: Metal Storm Limited, Queensland (AU)

( * ) Notice: Subject to any disclaimer, the term of this patent is extended or adjusted under 35 U.S.C. 154(b) by 348 days.

(21) Appl. No.: 10/555,510

(22) PCT Filed: May 3, 2004

(86) PCT No.: PCT/AU2004/000579

§ 371 (c)(1),
(2), (4) Date: Dec. 5, 2006

(87) PCT Pub. No.: WO2004/097326

PCT Pub. Date: Nov. 11, 2004

(65) Prior Publication Data

US 2007/0084102 A1 Apr. 19, 2007

(30) Foreign Application Priority Data

May 2, 2003 (AU) ..... 2003902103
May 9, 2003 (AU) ..... 2003902223

(51) Int. Cl.
*F41A 19/61* (2006.01)

(52) U.S. Cl. ..... 42/84; 89/14.05

(58) Field of Classification Search ..... 42/84; 89/14.05

See application file for complete search history.

(56) References Cited

U.S. PATENT DOCUMENTS 1,628,896 A 5/1927 Medearis
1,864,374 A 6/1932 Romberg et al.
3,169,333 A * 2/1965 Scanlon, Jr. ..... 42/69.01
3,307,451 A 3/1967 Bucklisch et al.
3,421,244 A * 1/1969 Reed ..... 42/69.01
3,505,927 A 4/1970 Driscoll
3,611,867 A 10/1971 Silsby
3,650,174 A 3/1972 Nelsen
3,762,087 A * 10/1973 Strubin ..... 42/84
3,815,271 A * 6/1974 Lynn ..... 42/84
3,854,231 A 12/1974 Broyles
3,946,637 A 3/1976 Campagnuolo et al.
3,952,658 A 4/1976 Broyles
4,036,141 A 7/1977 Korr et al.
4,135,455 A 1/1979 Wallace (Continued)

FOREIGN PATENT DOCUMENTS

FR 1508326 11/1966

(Continued)

*Primary Examiner*—Stephen M Johnson
(74) *Attorney, Agent, or Firm*—Sonnenschein Nath & Rosenthal LLP

(57) ABSTRACT

A projectile (28) for a barrel assembly (10) containing multiple projectiles (28) including a propellant charge (22), a primer (23, 26) that ignites the propellant charge (22), a payload (28) that is propelled from the barrel (10) on ignition of the charge (22), and ignition system (20, 24, 25) having both an electrical (20, 24) and a mechanical (25, 26) subsystem either or both of which may be triggered to ignite the primer (23). The electrical system may involve induction white the mechanical system may involve a solenoid or fully mechanical arrangement, the mechanical system acts as a backup for the electrical system if required.

19 Claims, 6 Drawing Sheets

U.S. PATENT DOCUMENTS

Figure 1:
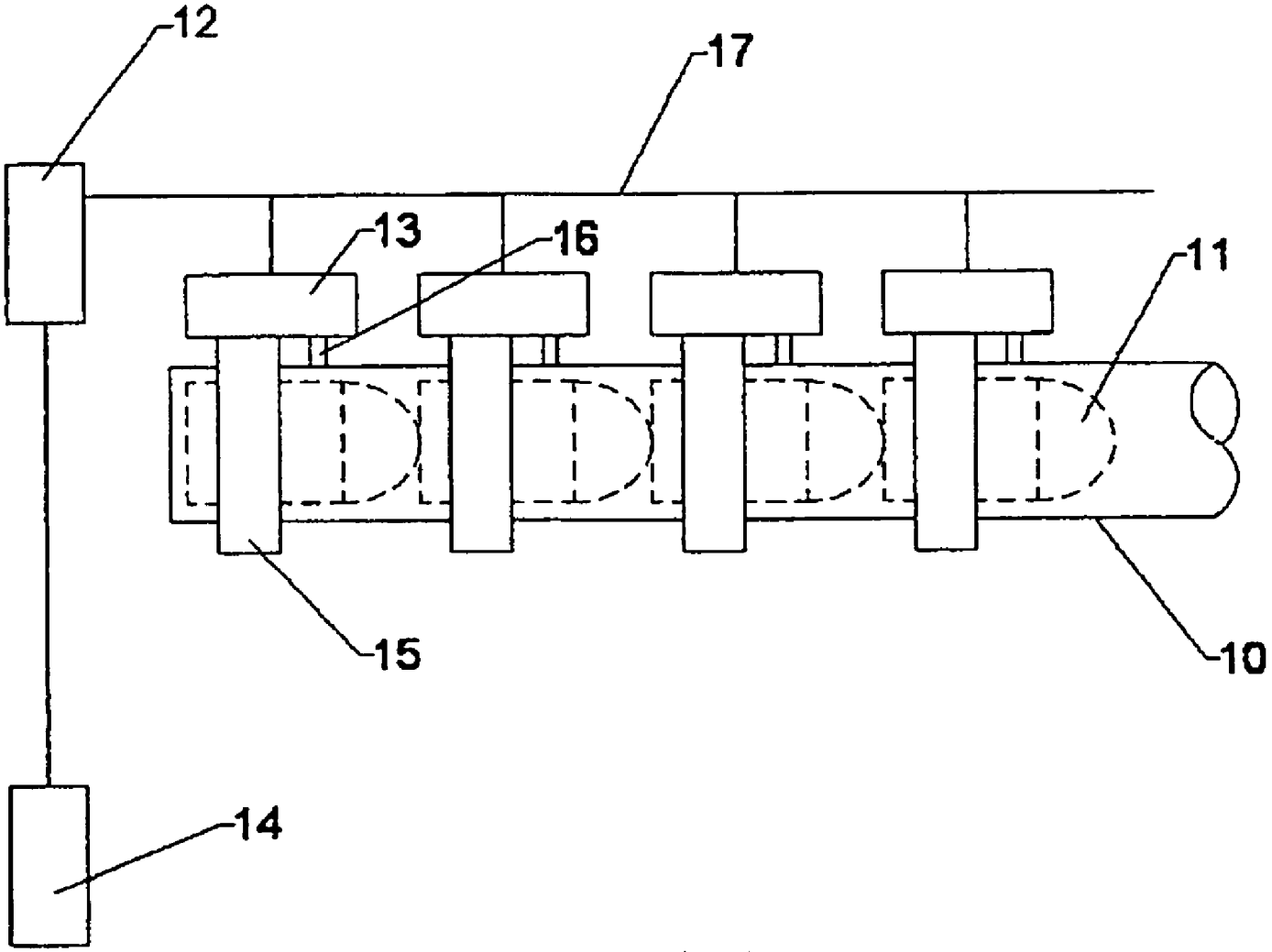

| | | | | | |
|---|---|---|---|---|---|
| 4,155,285 | A | | 5/1979 | Kratzenberg et al. | |
| 4,159,070 | A | * | 6/1979 | Monson | 227/10 |
| 4,285,153 | A | | 8/1981 | Crouch | |
| 4,422,041 | A | * | 12/1983 | Lienau | 324/207.23 |
| 4,709,615 | A | | 12/1987 | Field | |
| 5,097,614 | A | | 3/1992 | Strong | |
| 5,329,840 | A | * | 7/1994 | Corney | 89/135 |
| 5,901,488 | A | | 5/1999 | Oberlin | |
| 5,992,291 | A | | 11/1999 | Widder et al. | |
| 6,032,568 | A | | 3/2000 | Fuller et al. | |
| 6,138,395 | A | * | 10/2000 | O'Dwyer | 42/84 |

FOREIGN PATENT DOCUMENTS

| | | | |
|---|---|---|---|
| FR | 2400688 | | 3/1979 |
| WO | 1997/04281 | | 2/1997 |
| WO | 1998/55817 | | 12/1998 |
| WO | 1998/55819 | | 12/1998 |
| WO | 2001/33253 | A2 | 5/2001 |
| WO | 2001/46010 | A2 | 6/2001 |
| WO | 2003/004102 | A1 | 1/2003 |
| WO | 2003/006912 | A1 | 1/2003 |
| WO | 2003/006915 | A1 | 1/2003 |
| WO | 2003/006916 | A1 | 1/2003 |

* cited by examiner 60
64
62
61
66
67
66

65
68
64
69
70
71
63
66
60

COMBINED ELECTRICAL MECHANICAL FIRING SYSTEMS

The present application is a U.S. National Phase Application of International Application No. PCT/AU2004/000579 filed 3 May, 2004, which claims priority from Australian Application Nos.: 2003902223 filed 9 May, 2003, and 2003902103 filed 2 May 2003.

BACKGROUND TO THE INVENTION

This invention relates to firing systems for weapons having multiple projectiles that are stacked in a common barrel. Weapons of this kind are usually fired by a fully electrical control system but sometimes require a backup firing system, preferably a mechanical system. Weapons having stacked projectiles are described in WO 94/20809 and WO 97/04281, and a series of later specifications, for example.

SUMMARY OF THE INVENTION

It is an object of the invention to provide a combined electrical and mechanical firing system for weapons having stacked projectiles, or at least to provide an alternative to existing systems.

In one aspect the invention is a projectile for a barrel assembly containing multiple projectiles, including: a propellant charge, a primer that ignites the propellant charge, a payload that is propelled from the barrel on ignition of the charge, and an ignition system having both an electrical and a mechanical subsystem either or both of which may be triggered to ignite the primer.

Preferably the electrical subsystem includes an SCB embedded in the primer that is triggered by induction from a coil in the barrel. Preferably the mechanical subsystem includes an auxiliary primer that is triggered by a firing pin in the barrel, connected to a piezoelectric generator that triggers the main primer.

In another aspect the invention is a barrel for a barrel assembly containing multiple projectiles, including a plurality of projectile firing systems for respective projectiles, each system having both electrical and mechanical subsystems.

Preferably each electrical firing subsystem is an induction system. Preferably each mechanical firing system incorporates a solenoid having a core that operates through the barrel as a firing pin.

In further aspects the invention is a barrel assembly and a method of firing a weapon having a barrel or barrel assembly of this general kind.

LIST OF FIGURES

Figure 2:
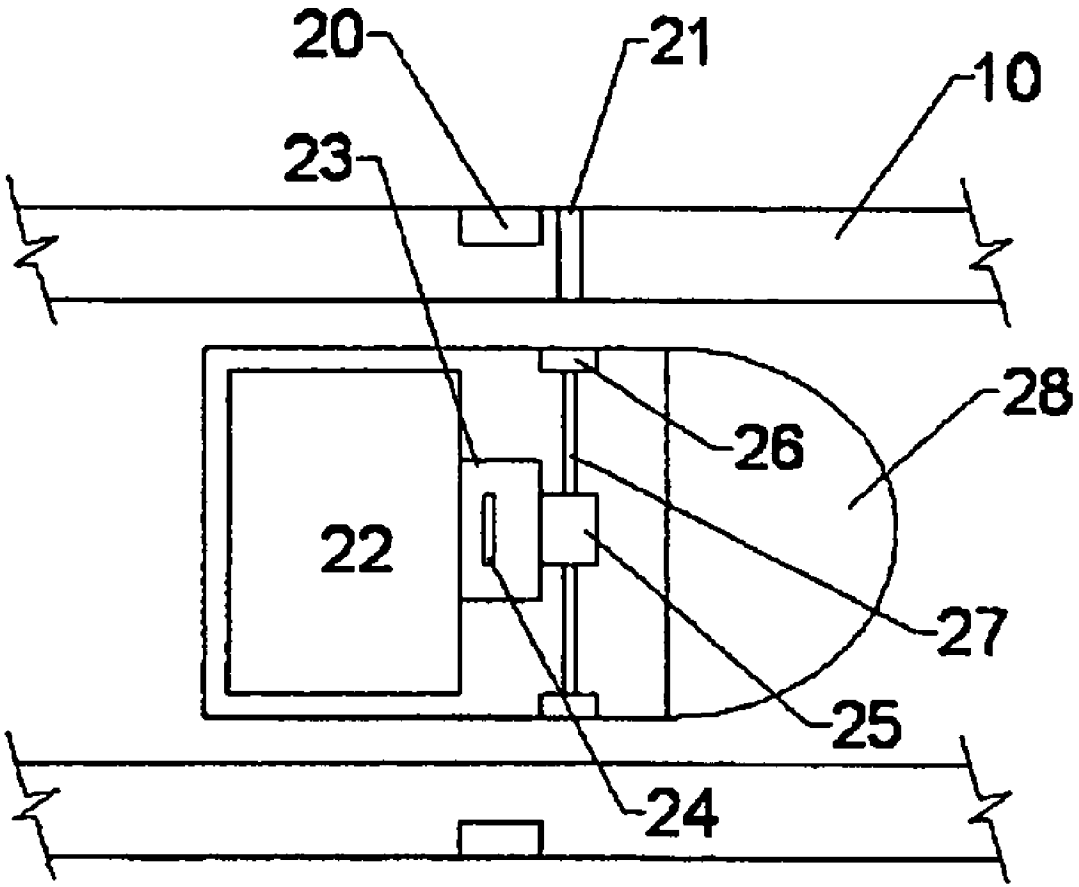
Figure 3:
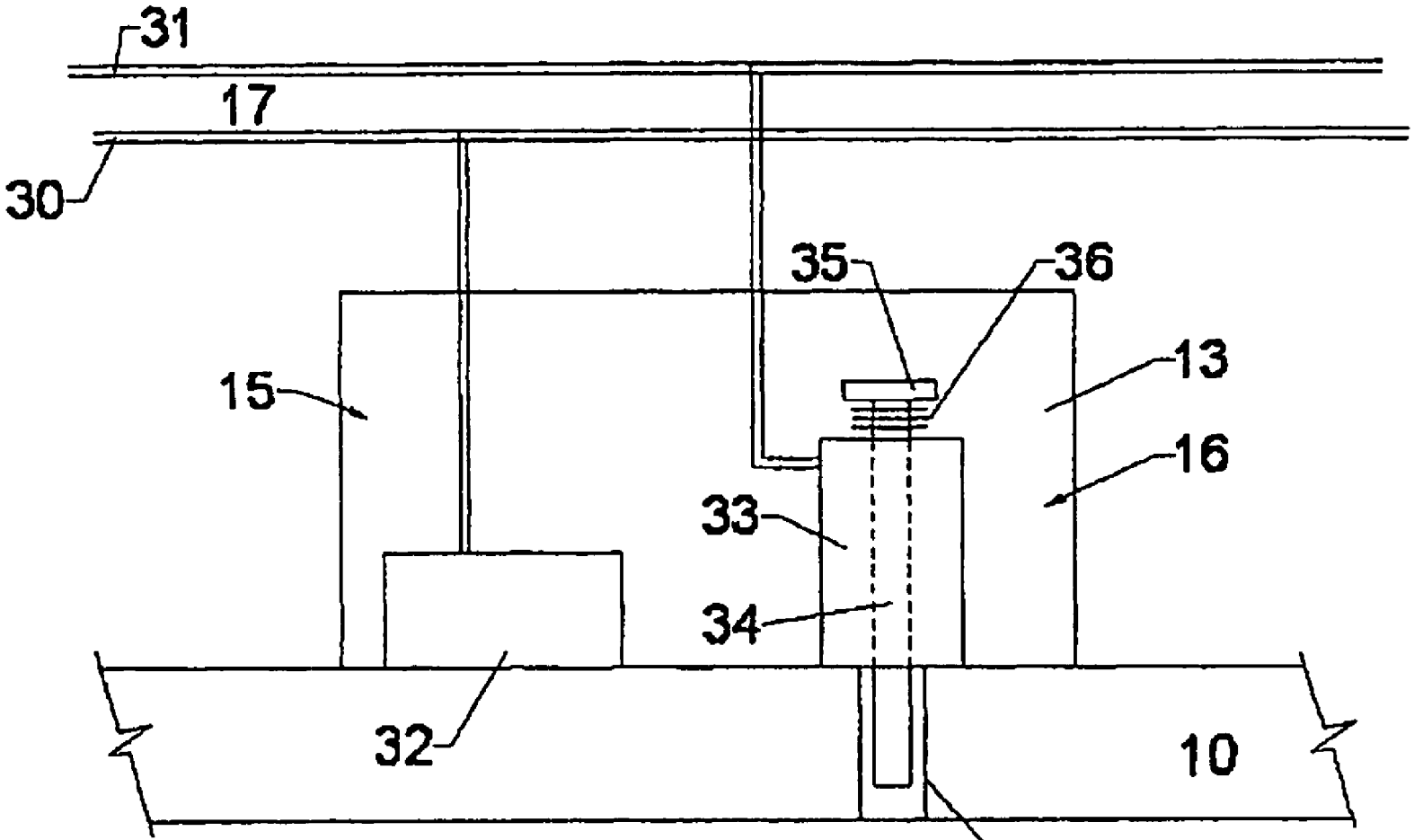
Figure 4:
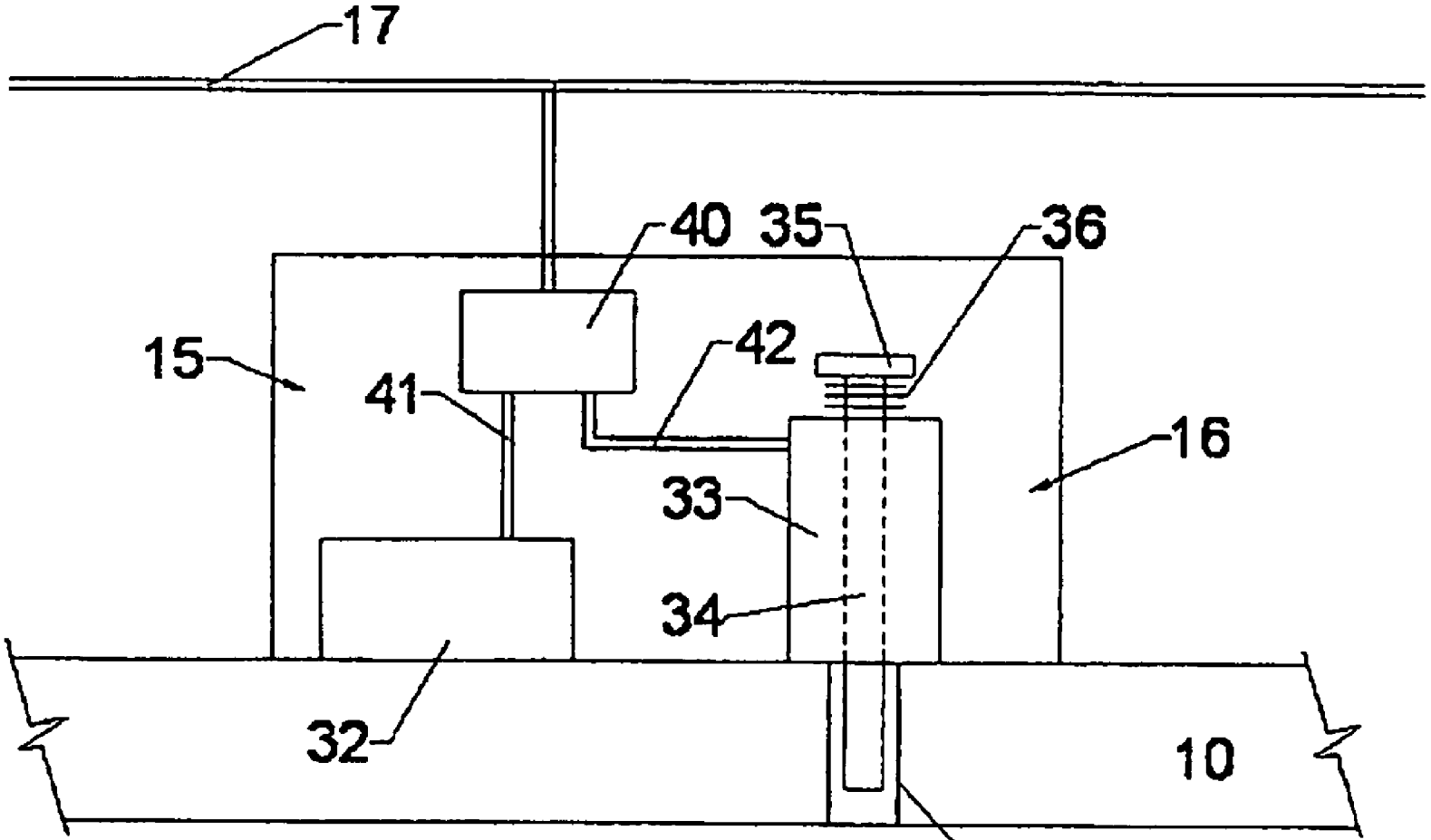
Figure 5:
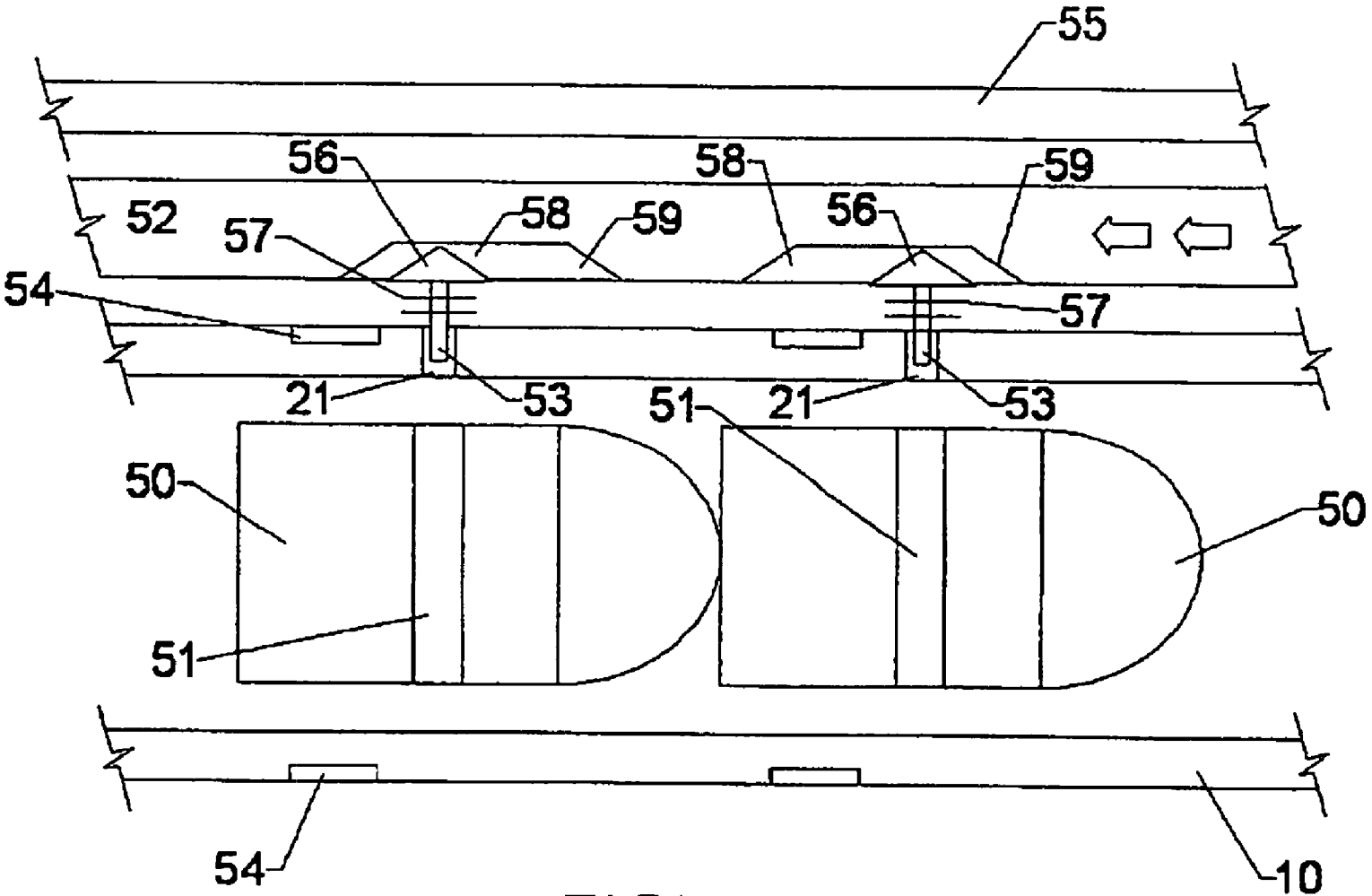
Figures 6A, 6B:
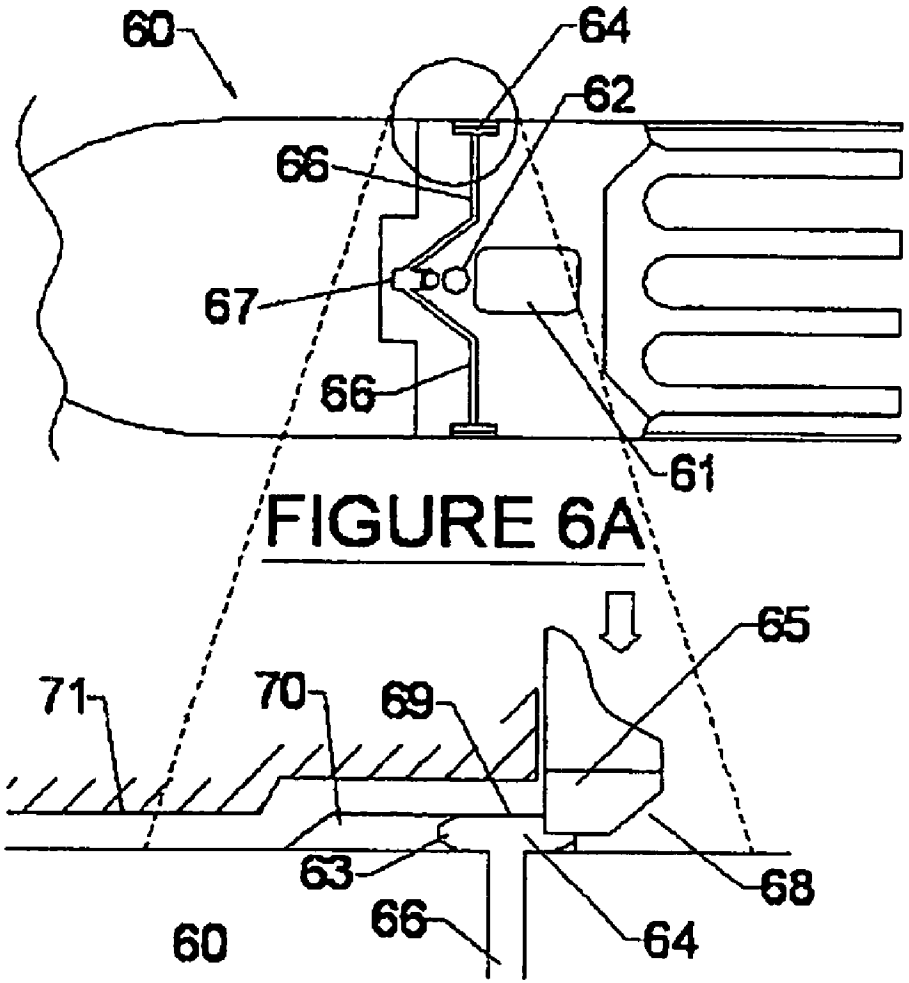

Preferred embodiments of the invention will be described with respect to the accompanying drawings, of which:

FIG. 1 schematically shows a weapon having combined electrical and mechanical firing systems, FIG. 2 is a cross-section of a projectile that may be used in a combined electrical and mechanical firing system, FIG. 3 is a cross-section of a barrel showing part of a combined firing system in more detail, FIG. 4 is a cross-section of a barrel showing part of an alternative combined firing system in more detail, FIG. 5 is a further cross-section of a barrel showing part of a further alternative firing system in more detail, and FIGS. 6A, 6B are further cross-sections of a projectile for a combined system.

DETAILED DESCRIPTION OF THE DRAWINGS

Referring to the drawings it will be appreciated that the invention may be implemented in a variety of ways for different weapon systems. Details of these weapon systems such as loading and aiming subsystems will be understood by a skilled reader and need not be described in detail. This description is given by way of example only.

FIG. 1 schematically shows a weapon having multiple stacked projectiles. The weapon has a barrel 10 with four projectiles 11, indicated by way of example. It may be a relatively small calibre weapon such as a firearm, or a larger device mounted on a vehicle or aircraft. The projectiles may be provided in a range of different types for different purposes with variable numbers being present in the barrel as required. The projectiles each contain a propellant charge and may be sealed in a range of different ways to prevent blow-by of combustion gases, such as wedge sealing of each projectile against the bore of the barrel, a nose to tail seal between adjacent projectiles, perhaps forming a rigid "stick", or individually sealed systems provided within each projectile. The barrel may include other components such as sensors or setters that interact with projectiles at the muzzle of the barrel. These systems have been omitted for clarity and generality.

The weapon in FIG. 1 includes a firing controller 12 that operates a firing system 13 for each of the projectiles 11. The firing controller is in turn usually operated by an external source 14 such as a manual trigger in the case of a firearm or a computer system in the case of an automated weapon. Each projectile firing system 13 has two main components, namely an electrical subsystem 15 and a mechanical subsystem 16, both operated by the controller via a generalised control system 17. Preferably each electrical system 15 involves an inductive interaction with the respective projectile, hence the indication of a coil surrounding the barrel in each case. Other electrical systems are possible, such as direct contact arrangement involving electrical contacts on the bore of the barrel and the outside of each projectile.

FIG. 2 is a cross section through a typical projectile 11 in FIG. 1 located in the barrel 10. An induction coil 20 is shown embedded in the barrel for the preferred electrical firing system, with an aperture 21 for the firing pin of a preferred mechanical firing system. The projectile includes a propellant charge 22 of various kinds as required, triggered by a primer 23 that in turn may be ignited in one or other of at least two different ways, preferably electrical and mechanical in nature. A semiconductor bridge device (SCB) 24 is shown embedded in the primer for activation by the induction coil 20, as an electrical ignition system, and a mechanical device 25 such as a piezoelectric element is shown adjacent to the primer for activation by a largely mechanical ignition system. The projectile includes a payload 28 that may be of different types for a range of purposes, although the term payload may also refer generally to those parts of the projectile as a whole that are not concerned with the firing process.

The mechanical ignition system in FIG. 2 includes an auxiliary primer 26 that is activated by direct contact of a firing pin through aperture 21. The primer 26 preferably surrounds the projectile in a band but may be provided in one or more circumferential portions requiring more careful alignment of the projectile within the barrel. One or more passages 27 extend inwards from the auxiliary primer 26 to the mechanical device 25 to activate the device and thereby ignite the main primer 23, in response to ignition of the auxiliary primer. Alternative systems are also possible, such as a spring loaded hammer or a partially electrical system. It is possible to trigger the mechanical system substantially simultaneously with the electrical system, or afterwards if the electrical system is sensed to have failed.

FIG. 3 shows a firing system 13 for a particular projectile in FIG. 1, incorporating an electrical system 15 and a largely mechanical system 16, way of example. The firing system is operated by the firing controller 12 along control path 17 which in this case involves dual wire lines 30, 31 for the systems 15 and 16 respectively. The electrical system includes a coil 32 wound outside the barrel. The line 30 and a series of coils along the barrel, convey coded signals from the controller 12 that are detected by individual SCB devices in the projectiles and used to fire the projectiles in sequence from the barrel. The mechanical system involves a solenoid 33 having a core 34. The core acts a firing pin for the particular projectile through aperture 21 in the barrel. Movement and position of the core is determined by activation of the solenoid, and by a cap 35 in conjunction with a spring 36. The solenoid is pulsed by the controller 12, either along a separate line 31 or using a code system on a common line, to drive the core through the aperture into contact with the projectile.

FIG. 4 shows an alternative firing system 13 for a particular projectile. This system is similar to that of FIG. 3 except that a single control line 17 now addresses each firing system to convey a coded signal from the firing controller 12. A sensor trigger device 40 receives the signal from the controller and determines whether or not the particular projectile is to be fired and the manner in which it is to be fired. The sensor then activates either the coil 32 or the solenoid 33, or both. A coded ignition signal could still be conveyed by the coil 32 to the projectile for additional security, although a simplified SCB device and simplified signal could alternatively be used. The sensor may also determine whether the projectile has successfully fired, by way of a pulse received back through the coil from a magnet on the projectile for example.

FIG. 5 schematically shows part of a fully mechanical firing system 16 in FIG. 1, based on the system described in U.S. Pat. No. 3,421,244 (Reed). Two projectiles 50 are shown in barrel 10, each with combined electrical and mechanical systems as indicated in FIG. 2. Each has an auxiliary primer 51 shown in the form of a band or rim, and contains electrical and mechanical ignition systems as previously described. Control system 17 now includes a shaft 52, shown in cross-section, that is able to slide parallel with the barrel 10, driven either by mechanical action of a manual trigger or an automated system. The shaft actuates firing pins 53 through apertures 21, in a process separate from activation of the induction coils 54 that are embedded in the barrel, in this example. The shaft is contained in a conduit indicated by an upper wall 55. Each firing pin includes a cap 56 and a spring 57 held between the cap and the barrel. The shaft 52 includes recesses 58 that interact with the caps in sequence beginning with the leading projectile in the barrel.

The mechanical firing system in FIG. 5 operates by movement of the shaft 52 incrementally up the barrel 10 as indicated by the full arrows. Each recess 58 has a leading edge 59 that engages a corresponding cap 56. The recesses sequentially engage the caps and thereby actuate the respective firing pins 53 through apertures 21 into contact with the respective projectile. The recesses are spaced along the shaft differently to the firing pins so the respective caps are engaged sequentially in stepwise fashion, firing the leading projectile at each step. The mechanical system operates as a backup to the electrical inductive system, if it is determined that any particular projectile has not fired through the signal coil, or possibly simultaneously with the electrical system.

FIGS. 6A, 6B show an alternative projectile 60 in more detail. The rear portion of the projectile 60 has a propellant charge 61 and a primer 62 that may be ignited by either an electrical or mechanical or possibly optical (eg. laser) system. The electrical system includes an SCB (not shown) embedded in the primer activated by induction as described above. The mechanical system includes an outer chamber 63 of generally annular configuration containing an auxiliary primer 64 for initiation by impact from a firing pin 65. Actuation of the firing pin may take place in a variety of ways such as the partly or fully mechanical firing systems described above. Passages 66 extend radially inward to a central region of the projectile and convey pressure waves that drive a piezoelectric generator 67, or alternatively another system having an interaction with primer 62.

FIG. 6B is a detailed view of the firing pin 65 protruding through an aperture in the barrel 71. The pin has a chamfered trailing edge 68 to avoid jamming which might otherwise occur when the pin strikes and deforms the external rim fire band 69, as the projectile leaves the barrel. An obturator ring 70 is place circumferentially around the body of the projectile 60 in advance of the rim fire band to minimise the possibility of interference by the firing pin 65.

The invention claimed is:

1. A barrel assembly including:

a barrel with a plurality of projectiles aligned nose to tail for sequential firing, each projectile being associated with a propellant charge, a primer that ignites the propellant charge, and an ignition system triggerable to ignite the primer and thereby fire the projectiles;

a plurality of firing systems, each firing system being for a respective projectile and including (i) a sensor for determining whether the respective projectile has successfully fired, and (ii) an induction coil coupled to the sensor, wherein the sensor is configured for detecting the respective projectile using a signal received from the coil; and a firing controller coupled to each of the firing systems, the firing controller being for operating the firing systems to thereby:

determine whether or not a respective projectile is to be fired; and selectively trigger respective ones of the ignition systems to thereby fire associated ones of the respective projectiles.

2. A barrel assembly according to claim 1, wherein the firing controller is coupled to each firing system via a respective control line.

3. A barrel assembly according to claim 1, wherein each firing system is positioned on the barrel for triggering the ignition system of the respective projectile.

4. A barrel assembly according to claim 1, wherein each firing system is positioned on the barrel adjacent the respective projectile.

5. A barrel assembly according to claim 1, wherein the sensor is configured for detecting a magnetic field associated with the projectile.

6. A barrel assembly according to claim 5, wherein each projectile includes a magnet.

7. A barrel assembly according to claim 1, wherein the firing controller is configured to operate the firing systems to determine whether or not the respective projectiles are to be fired by determining from the sensor whether the respective projectiles have been successfully fired.

8. A barrel assembly according to claim 1, wherein the sensor is configured for activating the coil to thereby inductively trigger the ignition system.

9. A barrel assembly according to claim 1, wherein the induction coil is at least one of surrounding and embedded within the barrel.

10. A barrel assembly according to claim 1, wherein each ignition system includes an SCB embedded in the primer that is triggered by induction from the coil.

11. A barrel assembly according to claim 1, wherein the firing controller is configured for generating coded signals, the firing system being configured for:

receiving the coded signals; and, selectively triggering the ignition system.

12. A barrel assembly according to claim 11, wherein the coded signal is configured for determining a manner in which a projectile is to be fired.

13. A barrel assembly according to claim 1, wherein the firing controller is configured for generating a coded signal and the coded signal is conveyed to the ignition system by the induction coil, and wherein the ignition system is configured for detecting the coded signal and igniting the primer.

14. A barrel assembly according to claim 1, wherein each ignition system has a backup firing system.

15. A barrel assembly according to claim 14 wherein each firing system incorporates a solenoid having a core that operates through the barrel as a firing pin.

16. A barrel assembly according to claim 14 wherein each firing system has a firing pin that operates through the barrel in response to movement of a sliding shaft adjacent to the barrel.

17. A barrel assembly according to claim 14 wherein each ignition system includes an auxiliary primer that is triggered by a firing pin in the barrel.

18. A barrel assembly according to claim 1, wherein each ignition system has both an electrical and a mechanical subsystem either or both of which is triggerable to ignite the primer.

19. A barrel assembly according to claim 13, wherein the coded signal is configured for determining a manner in which respective ones of the projectiles are to be fired.

* * * * *